US008985325B2

(12) United States Patent
Otsuka et al.

(10) Patent No.: US 8,985,325 B2
(45) Date of Patent: Mar. 24, 2015

(54) CLOTHES IRON STORAGE CASE

(75) Inventors: Yasuharu Otsuka, Shiga (JP); Hiroshi Fujimoto, Shiga (JP); Kiichi Shimosaka, Shiga (JP); Toyohiko Yagi, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 434 days.

(21) Appl. No.: 13/504,372

(22) PCT Filed: Dec. 17, 2010

(86) PCT No.: PCT/JP2010/007328
§ 371 (c)(1),
(2), (4) Date: Apr. 26, 2012

(87) PCT Pub. No.: WO2011/077680
PCT Pub. Date: Jun. 30, 2011

(65) Prior Publication Data

US 2012/0211383 A1 Aug. 23, 2012

(30) Foreign Application Priority Data

Dec. 24, 2009 (JP) ..... 2009-291722
Dec. 24, 2009 (JP) ..... 2009-291723

(51) Int. Cl.
*B65D 85/00* (2006.01)
*D06F 79/00* (2006.01)
*D06F 79/02* (2006.01)

(52) U.S. Cl.
CPC ..... *D06F 79/00* (2013.01); *D06F 79/02* (2013.01)
USPC ..... 206/320; 206/1.5; 219/259; 38/107

(58) Field of Classification Search
USPC ..... 206/1.5, 320, 576, 701; 38/94, 141, 38/107; 219/246, 259
See application file for complete search history.

(56) References Cited

U.S. PATENT DOCUMENTS 2,074,159 A * 3/1937 Bailey ..... 206/320
2,439,004 A * 4/1948 Hurley ..... 38/142

(Continued)

FOREIGN PATENT DOCUMENTS

CN 2358099 Y 1/2000
JP 01-153189 A 6/1989

(Continued)

OTHER PUBLICATIONS

Supplementary European Search Report in corresponding European Application No. 10 83 8920, dated Oct. 29, 2013, 6 pages.

(Continued)

*Primary Examiner* — Jacob K Ackun
(74) *Attorney, Agent, or Firm* — Brinks Gilson & Lione

(57) ABSTRACT

An iron case includes: a table where an iron is placed; a receiving case that surrounds the iron and has a lower opening that is closed by the table; and a locking mechanism that detachably combines the table with the receiving case, in which the locking mechanism includes: a locking portion formed on the sides of the table; a locking body formed at the receiving case and engaged with the locking portion; an operating button disposed to be movable outwardly on the outer surface of the receiving case and operating the locking body; and a locking spring disposed in the receiving case and biasing the operating button to the table. Therefore, malfunction of the locking mechanism is prevented while usability when the receiving case is separated is improved.

7 Claims, 5 Drawing Sheets

(56) References Cited

U.S. PATENT DOCUMENTS

| | | | | |
|---|---|---|---|---|
| 3,483,954 | A * | 12/1969 | Michalski | 206/223 |
| 5,142,124 | A * | 8/1992 | Driessen | 219/247 |
| 6,917,015 | B2 * | 7/2005 | Choo | 219/247 |
| 8,146,276 | B2 * | 4/2012 | Pan et al. | 38/141 |
| 2005/0016035 | A1 * | 1/2005 | Kobayashi et al. | 38/96 |

FOREIGN PATENT DOCUMENTS

| | | | |
|---|---|---|---|
| JP | 07-124397 | A | 5/1995 |
| JP | 08-089699 | A | 4/1996 |
| JP | 10-99599 | A | 4/1998 |
| JP | 2000-005499 | A | 1/2000 |
| JP | 2001-327800 | A | 11/2001 |

OTHER PUBLICATIONS

International Search Report for International Application No. PCT/JP2010/007328, dated Mar. 29, 2011, 3 pages.

Chinese Search Report issued on Chinese application No. 201080058599.4, dated Apr. 18, 2014, 2 pages.

* cited by examiner

CLOTHES IRON STORAGE CASE

This application is a 371 application of PCT/JP2010/007328 having an international filing date of Dec. 17, 2010, which claims priority to JP2009-291722 filed Dec. 24, 2009 and JP2009-291723 filed Dec. 24, 2009, the entire contents of which are incorporated herein by reference.

TECHNICAL FIELD

The present invention relates to an iron case that receives an iron.

BACKGROUND ART

In the related art, iron cases that receive an iron are generally equipped with a table where an iron is placed, a receiving case that surrounds the iron and has a lower opening closed by the table, and a locking mechanism that combines the table with the receiving case. An example of an iron case having a configuration that prevents the locking mechanism, which combines the table with the receiving case, from being unlocked when the case is lifted and carried (for example, see PTL 1), has been disclosed.

According to the iron case described in PTL 1, a locking mechanism is unlocked by pressing an operating button, when a receiving case is separated from the table. In detail, the locking mechanism is unlocked by lifting up the receiving case, with the operating button pressed in the direction opposite to the direction in which the receiving case is lifted up and separated. Therefore, it has the advantage that the locking mechanism is not unexpectedly unlocked. However, it is difficult to unlock the locking mechanism when separating the receiving case from the table and it is inconvenient to use.

An example of an iron case that makes it easy to unlock a locking mechanism in consideration of the problem is disclosed (for example, PTLs 2 and 3).

A locking mechanism of an iron case of the related art which is described in PTL 2 is described with reference to FIG. 9.

FIG. 9 is a cross-sectional view showing the main parts of a locking mechanism of an iron case of the related art.

As shown in FIG. 9, receiving case 51 includes operating button 52, locking body 55 having engagement groove 53 and claw 54 protruding upward at operating button 52, and locking spring 56 biasing operating button 52 in the opposite direction to an unlocking direction (direction of an arrow AA). Table 57 has locking portion 58 having predetermined allowance (margin) in the vertical direction to be engaged with engagement groove 53 of locking body 55. As receiving case 51 is lifted up, locking portion 58 is fitted into engagement groove 53 of locking body 55 in response to relative separation of receiving case 51 and table 57. Accordingly, locking body 55 is prevented from moving in the direction of arrow AA of F*ig*.9, which is the unlocking direction of locking body 55.

Meanwhile, when receiving case 51 is separated from table 57, operating button 52 is operated in the direction of an arrow AA against the biasing force of locking spring 56. Operating button 52 being in contact with the outer side of receiving case 51 compresses locking spring 56. As a result, locking body 55 moves in the separation direction from table 57 and locking mechanism 59 is unlocked. Receiving case 51 is lifted up, with locking mechanism 59 unlocked by moving operating button 52 outward. Accordingly, receiving case 51 is separated from table 57.

However, in the iron case having the configuration of the related art, operating button 52 is disposed on the outer side of receiving case 51 to be exposed. The upper end portion of operating button 52, which corresponds to a point P on the outer side of receiving case 51, is movably biased inward by locking spring 56, by being in contact with point P on the outer side of receiving case 51. Accordingly, when unexpected external shock is applied to receiving case 51 that is being carried, receiving case 51 is instantaneously elastically deformed. The position of operating button 52 biased by locking spring 56 is displaced (moved) and deviates from a predetermined position.

As a result, the locking mechanism causes the following malfunction.

That is, operating button 52 is deviated from a predetermined position by external shock applied to receiving case 51 during carrying. As a result, locking portion 58 and claw 54 that prevent locking body 55 from moving in the unlocking direction are damaged. Since operating button 52 is exposed on the outer side of receiving case 51, the degree of damage increases when external shock is applied directly.

Hereafter, a mechanism that causes malfunction in locking mechanism 59 is described in detail.

In general, receiving case 51 is made of thermally-resistant thermo-plastic resin, for example, ABS resin, which is strong against shock and has high elasticity in order to be able to receive a heavy iron that remains hot after being used. Therefore, the elastic deformation of receiving case 51 which is generated when external shock is applied is instantaneously restored. However, operating button 52 is disposed to be movable by locking spring 56 in receiving case 51. Therefore, when deviating from a predetermined position by external shock, operating button 52 remains in the deviated state. When a hot iron is received after being used, the internal temperature of receiving case 51 increases and receiving case 51 may also be heated, such that elastic deformation becomes easy to occur; therefore, the operating button is more easily moved from a predetermined position. These are factors that cause malfunction in locking mechanism 59.

Therefore, the iron case having the configuration described above has a problem in that it is difficult to achieve both easy unlocking operability when separating a receiving case and at the same time preventing the malfunction in the locking mechanism with respect to the external shock.

PTL 1: Japanese Patent Unexamined Publication No. 1-153189

PTL 2: Japanese Patent Unexamined Publication No. 7-124397

PTL 3: Japanese Patent Unexamined Publication No. 8-89699

SUMMARY OF THE INVENTION

An iron case of the present invention includes a locking mechanism combining a table with a receiving case. The locking mechanism includes a locking portion formed at the table, a locking body engaged with the locking portion, an operating button operating the locking body, and a locking spring biasing the operating button to the table. Therefore, an iron case is achieved.

According to this configuration, it is possible to make the operation for unlocking that lifts up the receiving case easy after moving the operating button outward. Further, it is possible to prevent malfunction of the locking mechanism by alleviate external shock applied to the locking body, by damping the external shock of the receiving case outside the locking body inserted in the locking portion.

DETAILED DESCRIPTION OF THE PREFERRED EMBODIMENTS

Hereinafter, embodiments of the present invention will be described with reference to the drawings. The present invention is not limited by the embodiments.

First Exemplary Embodiment

Figure 1:
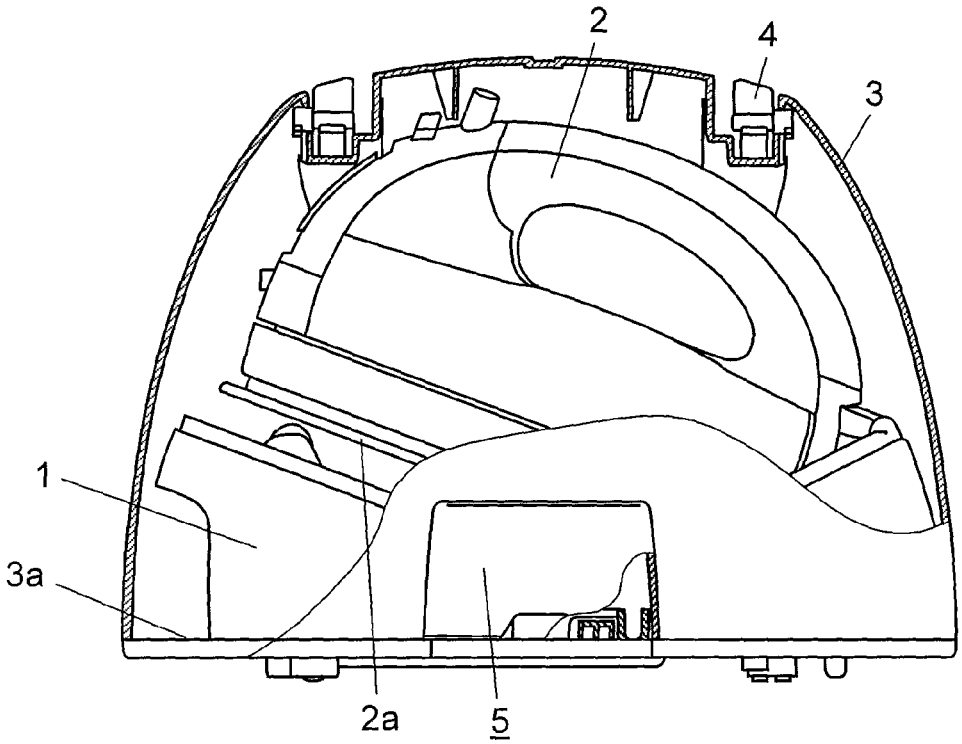
FIG. 1 is a partial cross-sectional side view of an iron case according to a first embodiment of the present invention.
Figure 2:
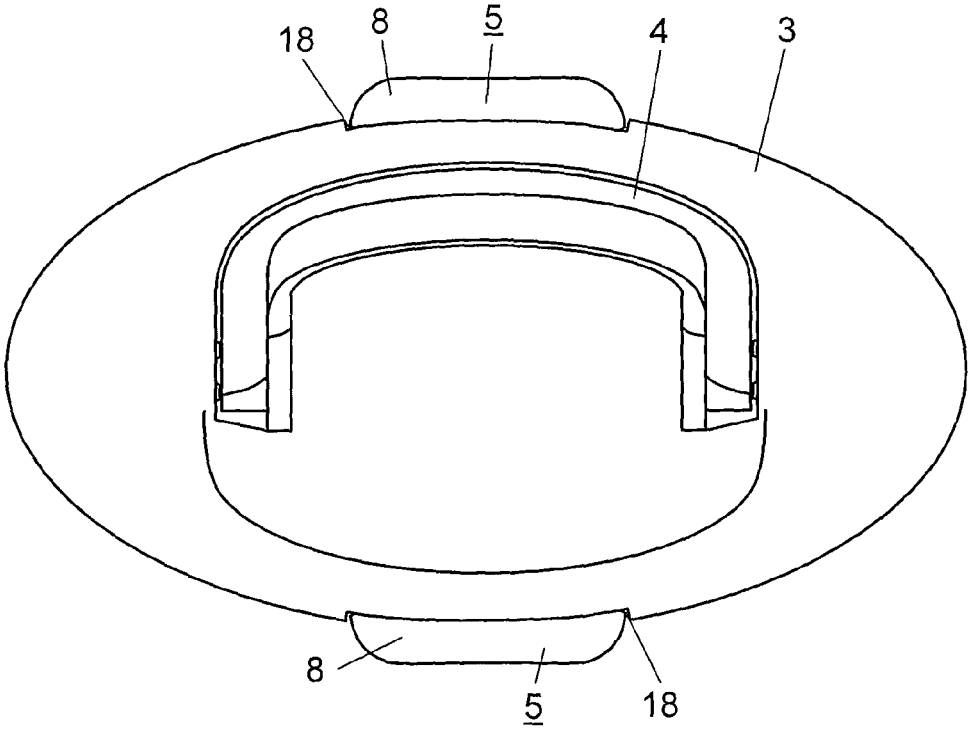
FIG. 2 is a top view of the iron case.
Figure 3:
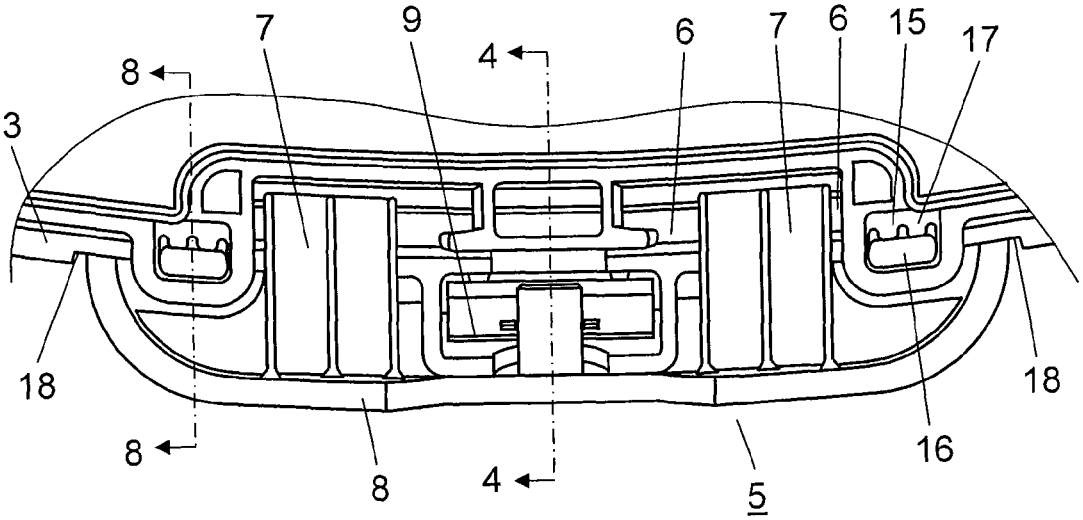
FIG. 3 is a bottom view of a locking mechanism of the iron case.
Figure 4:
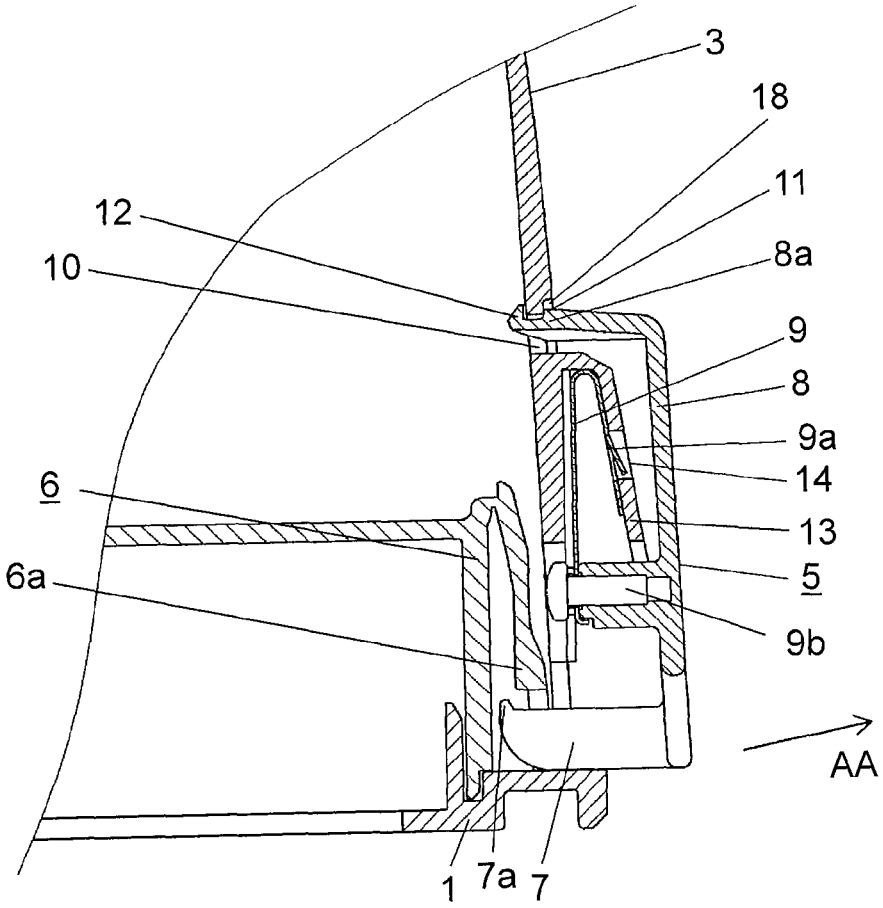
FIG. 4 is a longitudinal cross-sectional view of the iron case, taken along line 4-4 of FIG. 3.
Figure 5:
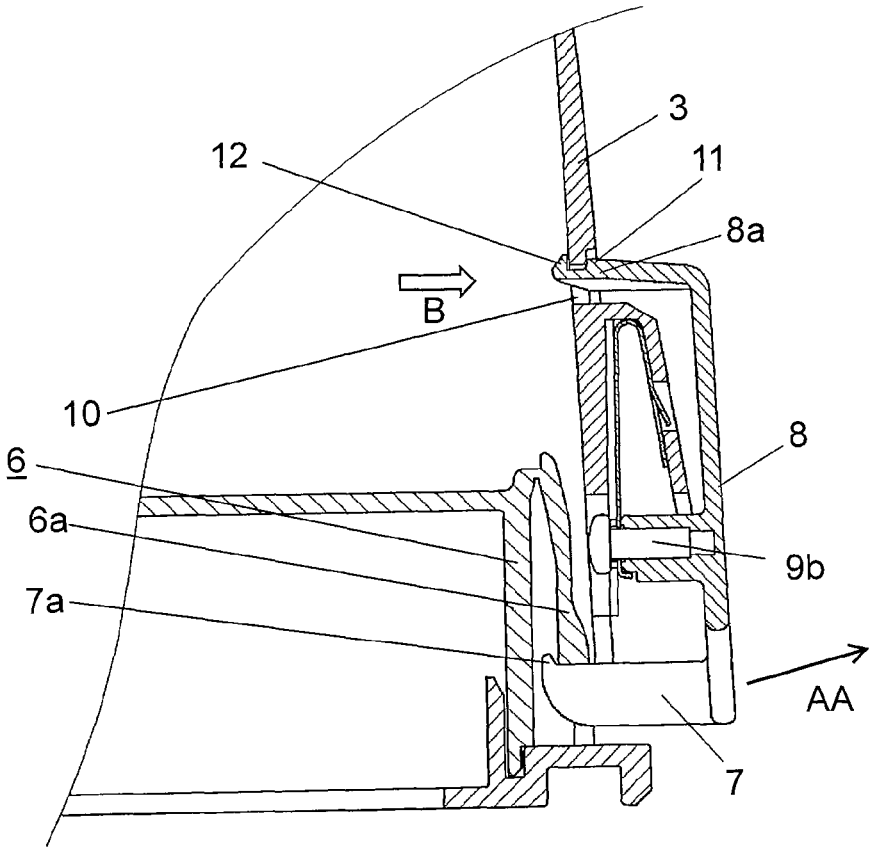
FIG. 5 is an operational view of the iron case.
Figure 6:
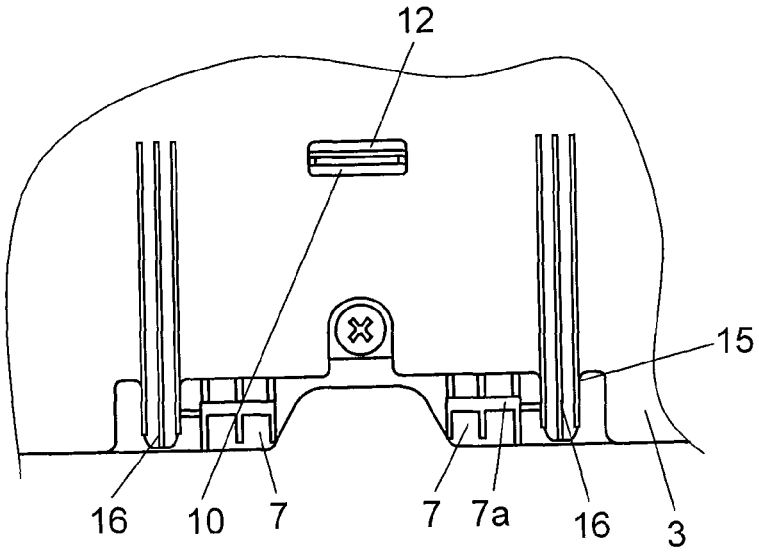
FIG. 6 is a view of the iron case, seen from the arrow B of FIG. 5.
Figure 7:
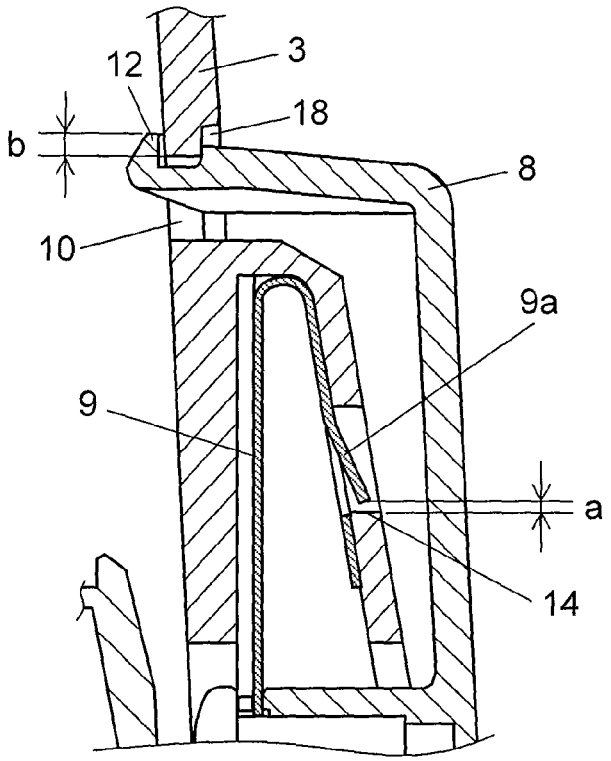
FIG. 7 is an enlarged cross-sectional view of the locking mechanism of the iron case.

FIG. 1 is a partial cross-sectional side view of an iron case according to a first embodiment of the present invention. FIG. 2 is a plan view of the iron case. FIG. 3 is a bottom view of the locking mechanism. FIG. 4 is a cross-sectional view taken along the line 4-4 of FIG. 3. FIG. 5 is an operational view of the iron case. FIG. 6 is a view seen from arrow B of FIG. 5. FIG. 7 is an enlarged cross-sectional view of the locking mechanism of the iron case.

As shown in FIGS. 1 to 7, an iron case includes at least table 1, receiving case 3 with handle 4 at the upper portion, and locking mechanism 5 combining table 1 with receiving case 3.

Iron 2 is placed on table 1, as shown in FIG. 1, with the front at an angle and underside 2*a* of iron 2 facing down. Receiving case 3 is made of thermally-resistant thermo-reversible resin, such as ABS resin, and receives iron 2 by surrounding and covering iron 2 placed on table 1 from the upper portion and closing opening 3*a* disposed in a lower portion by table 1.

Handle 4 that is held by hand for carrying is disposed at the upper portion of receiving case 3 to be able to turn, as shown in FIG. 2. Locking mechanisms 5 are disposed in a pair to face, for example, the long sides of table 1 and receiving case 3, that is both sides in the front-rear direction of placed iron 2, close to opening 3*a* at the lower end of receiving case 3. Therefore, table 1 and receiving case 3 are separably combined. As shown in FIGS. 3 and 4, locking mechanism 5 is composed of a pair of locking portions 6 disposed along both sides of the long sides of table 1, locking bodies 7 disposed at receiving case 3 and engaged with locking portions 6 from the lower portion, and operating buttons 8 disposed on both outer sides of the long sides of receiving case 3 to be movable outwardly. Locking portion 6 has locking piece 6*a* having a tongue shape, for example. Locking body 7 has protrusion 7*a* at the front end having a substantially rectangular shape to be engaged with locking portion 6 and is disposed at both sides in the front-rear direction of locking spring 9 disposed along a side of table 1.

As shown in FIG. 4, locking body 7 is integrally formed with the lower portion of operating button 8 and at least projection 7*a* protrudes toward table 1 further than the inner side of receiving case 3 to be engaged with locking portion 6. Locking spring 9 disposed in receiving case 3 is bent, for example, in a substantially U-shape, with one end thread-fastened to operating button 8 by screw 9*b* and the other end biasing operating button 8 to table 1 in contact with spring hooking portion 13.

As shown in FIG. 4, claw 8*a* disposed at the upper end portion of operating button 8 is inserted into hole 10, which is formed at a side of receiving case 3, from the outside. Claw 8*a* has first contact portion 11 being in contact with the outer surface around hole 10 and second contact portion 12 being in contact with the inner surface around hole 10 and is slidably engaged with the upper portion in hole 10 formed at receiving case 3. Hooking portion 9*a* that is cut downward and pulled outward is formed around the front end of locking spring 9. When locking spring 9 is inserted into spring hooking portion 13 formed in receiving case 3 from the lower portion, hooking portion 9*a* is fitted into receiving portion 14 formed in receiving case 3. In this state, when operating button 8 is moved down, the lower end of hooking portion 9*a* comes in contact with receiving portion 14, such that operating button 8 is prevented from separating from receiving case 3. Second contact portion 12 formed at claw 8*a* of operating button 8 keeps engaged with the inner surface of receiving case 3 by hole 10.

Further, as shown in FIG. 7, length b defined by overlapping second contact portion 12 and the inner surface of receiving case 3 is set to be larger than distance a from the lower end of hooking portion 9*a* formed at locking spring 9 to receiving portion 14 of receiving case 3, such that the relationship of $a<b$ is set.

Accordingly, an iron case according to the embodiment is achieved. Hereafter, the movement and the operation of the iron case having the configuration described above are described.

First, as shown in FIG. 4, when receiving case 3 is separated, operating buttons 8 at both left and right sides are operated in the direction of arrow AA against the biasing force of locking spring 9, with iron case placed. Accordingly, locking body 7 correspondingly moves in the direction of arrow AA together with operating buttons 8. In this operation, the lower end of locking portion 6 is positioned upward by the upper end of projection 7*a* protruding upward at the front end of locking body 7. Therefore, locking body 7 rotates in the direction of arrow AA against the biasing force of locking spring 9 and is disengaged from locking portion 6. It is possible to separate receiving case 3 from table 1 by lifting up receiving case 3, with locking body 7 and locking portion 6 disengaged.

In this state, claw 8*a* formed at the upper end portion of operating button 8 is inserted in hole 10 and first contact portion 11 is in contact with the outer surface of receiving case 3 around hole 10. Therefore, when the lower end of operating button 8 is operated in the direction of arrow AA, outward elastic deformation of receiving case 3 is suppressed, such that operating button 8 can be accurately operated.

Second contact portion 12 is in contact with the inner surface of receiving case 3 around hole 10. Therefore, when operating button 8 is further operated in the direction of arrow AA, receiving case 3 is elastically deformed outward with compression of locking spring 9. Accordingly, it is possible to easily separate receiving case 3 from table 1.

That is, when receiving case 3 is separated and operating button 8 is operated in the unlocking direction, receiving case 3 is pressed by first contact portion 11, such that outward elastic deformation is suppressed and locking spring 9 is compressed; therefore, it is possible to accurately move (rotate) operating button 8. Further, when receiving case 3 that has been unlocked is lifted up, second contact portion 12 presses receiving case 3 in the outward elastic deformation direction. Accordingly, claw 8*a* can continuously change the direction of deformation acting on receiving case 3 until locking body 7 is deviated from locking portion 6 and after the deviation. As a result, it is possible to easily unlock operating button 8.

Next, a work of the iron is finished and iron 2 is received, iron 2 is placed on table 1 and receiving case 3 is placed and slowly moved down to cover iron 2 from the above. In this operation, locking body 7 is engaged with locking portion 6 against the biasing force of locking spring 9. As receiving case 3 is combined with table 1, operating buttons 8 are biased to table 1 by locking spring 9, such that locking body 7 keeps engaged state with locking portion 6.

When iron case with receiving case 3 and table 1 combined is carried, as handle 4 formed at the upper portion of receiving case 3 is held and moved up, locking body 7 is moved up with receiving case 3. Therefore, as shown in FIGS. 5 and 6, locking body 7 is engaged with locking portion 6 from below and table 1 is lifted up. As a result, the upper end of projection 7*a* of locking body 7 is moved up further than the lower end between the side of receiving case 3 and locking piece 6*a* of locking portion 6. Accordingly, locking body 7 is engaged with locking portion 6 and prevents separation while restricting rotation of locking body 7 in the direction of arrow AA with projection 7*a* of locking body 7.

As described above, according to the embodiment, when iron 2 received in receiving case 3 is taken out, it is possible to easily perform the operation for unlocking by moving operating buttons 8 outward from the outer side of receiving case 3 and lifting up receiving case 3.

When handle 4 of receiving case 3 is held and carried and external shock due to hitting against an object is applied to receiving case 3, both sides of receiving case 3 are locked by claw 8*a* inserted in hole 10, such that it is possible to prevent positional deviation due to the shock by maintaining operating buttons 8 at predetermined positions. As a result, it is possible to preclude malfunction of locking mechanism 5 due to external shock.

Accordingly, it is possible to both make unlocking easy when separating receiving case 3 and prevent malfunction of locking mechanism 5 which is generated when external shock is applied during carrying.

According to the embodiment, hooking portion 9*a* that prevents separation from receiving case 3 is formed at locking spring 9. When the lower end of hooking portion 9*a* is moved until it comes in contact with receiving portion 14 of receiving case 3, claws 8*a* of operating buttons 8 keep engaged with the inner surface of receiving case 3 by first contact portion 11 and second contact portion 12. Accordingly, it is possible to restrict lower movement of operating button 8 by external shock. As a result, it is possible to prevent positional deviation of operating buttons 8 while preventing claws 8*a* of operating buttons 8 from separating from hole 10 of receiving case 3.

According to the embodiment, when the distance from the lower end of hooking portion 9*a* of locking spring 9 to receiving portion 14 of receiving case 3 is a and the length defined by overlapping second contact portion 12 and the inner surface of receiving case 3 is b, they are set to satisfy a<b. Accordingly, even if operating buttons 8 are moved down by external shock and the lower end of hooking portion 9*a* of locking spring 9 comes in contact with receiving portion 14 of receiving case 3, it is possible to keep second contact portion 12 engaged with the inner surface of receiving case 3. As a result, it is possible to prevent positional deviation of operating buttons 8 while preventing claws 8*a* of operating buttons 8 from separating from hole 10 of receiving case 3, According to the embodiment, even if operating buttons 8 are moved down and the lower end of hooking portion 9*a* of locking spring 9 comes in contact with receiving portion 14 of receiving case 3, a gap is defined between the lower edge of hole 10 where claw 8*a* is inserted and the lower end of claw 8*a*. As a result, it is possible to prevent claw 8*a* from being damaged by absorbing external shock in the vertical direction or left-right direction of operating buttons 8, for example, using the gap.

Second Exemplary Embodiment

An iron case according to a second embodiment of the present invention is described hereafter with reference to the drawings.

Figure 8:
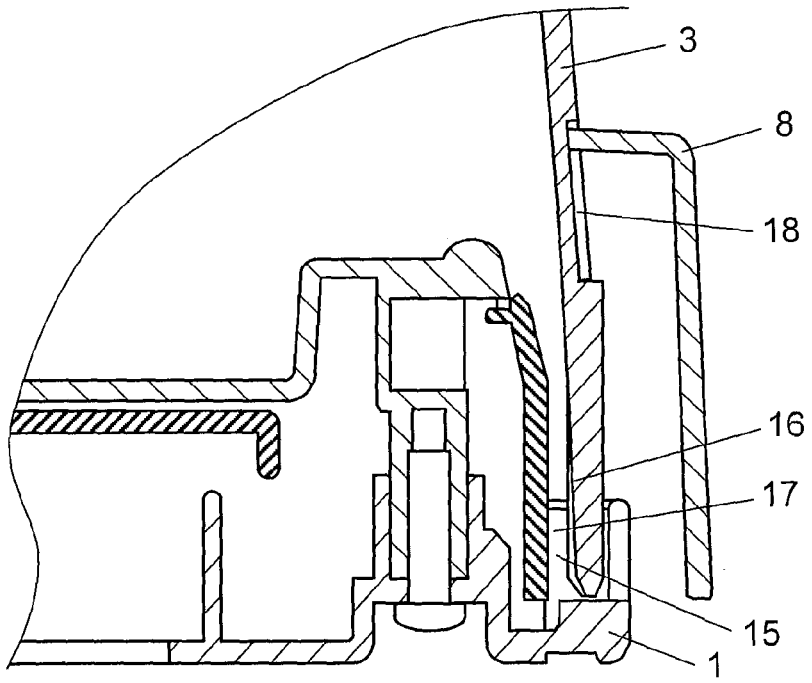
FIG. 8 is a cross-sectional view taken along line 8-8 of FIG. 3, which shows a locking mechanism of an iron case according to a second embodiment of the present invention.
Figure 9:
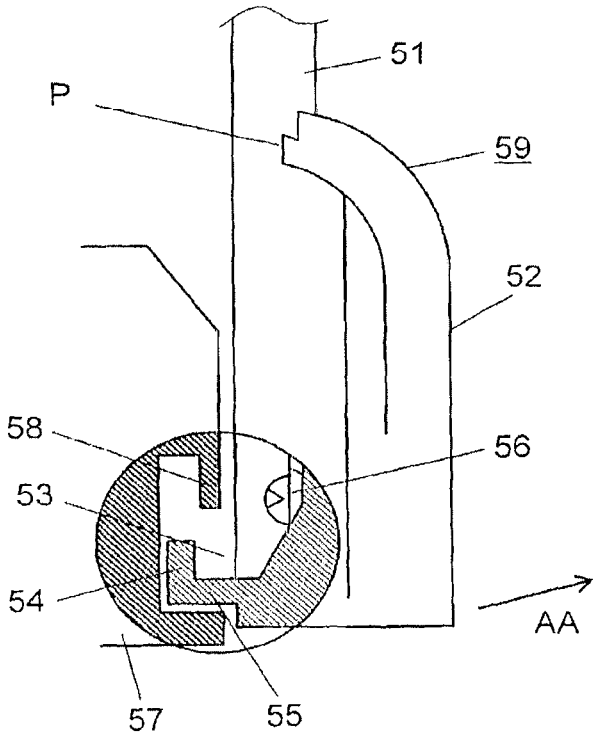
Fig. 9 (Prior Art)
FIG. 9 is a cross-sectional view showing the main parts of a lock mechanism of an iron case of the related art.

FIG. 8 is a cross-sectional view taken along the line 8-8 of FIG. 3, which shows a locking mechanism of an iron case according to a second embodiment of the present invention.

The embodiment further includes the following configuration, in addition to the configuration of the first embodiment.

That is, for an iron case according to the embodiment, in locking mechanism 5, engagement hole 15, for example, which has a rectangular shape is formed around locking portion 6 (see FIG. 3) of table 1, for example, engagement portion 16, as shown in FIG. 6, is formed in receiving case 3, opposite engagement hole 15. Recessed fitting portion 18 (see FIG. 3 for detail) where the outer circumferential edge of operating button 8 is fitted is formed on the outer surface of receiving case 3. The other configurations are the same as those of the first embodiment and the configuration of the first embodiment is referred for the detailed description That is, as shown in FIG. 8, engagement hole 15 is formed at the outer side (front and rear) of locking bodies 7 disposed at both sides in the front-rear direction of locking spring 9, along a side of table 1. When receiving case 3 is mounted, engagement portion 16 of receiving case 3 is inserted into engagement hole 15 of table 1. In this operation, engagement hole 15 has space 17 that allows engagement portion 16 to move into engagement hole 15, that is, to table 1, with engagement portion 16 inserted in engagement hole 15.

According to the embodiment, similar to the first embodiment, when iron 2 received in receiving case 3 is taken out, it is possible to lift up receiving case 3 after moving operating buttons 8 outward from the outer surface of receiving case 3. Therefore, the operation for unlocking becomes easy.

Further, when handle 4 of receiving case 3 is held by a hand and carried, it is possible to attenuate external shock applied in the front-rear direction of operating buttons 8 along the sides of table 1, at the outside of locking body 7 (front and rear) by using engagement portion 16 inserted in engagement hole 15. Accordingly, it is possible to maintain operating buttons 8 at predetermined positions by attenuating shock applied to locking body 7 positioned between engagement portions 16 disposed at the front and rear. As a result, it is possible to prevent malfunction of locking mechanism 5 due to positional deviation of operating buttons 8 by shock.

Further, according to the embodiment, space 17 is formed in engagement hole 15 of locking mechanism 5. Therefore, engagement portion 16 integrally formed with receiving case 3 can absorb shock applied to operating buttons 8 from the outside of the longitudinal sides of receiving case 3, by elastically deforming into space 17 (in the transverse direction). As a result, it is possible to reduce damage to engagement portion 16 and locking body 7 by shock.

Further, according to the embodiment, recessed fitting portion 18 where the outer circumferential edge of operating button 8 is inserted is formed on the outer surface of receiving case 3. Therefore, it is possible to absorb and distribute shock applied to the operating button in several directions, by operating buttons 8 of which the outer circumferential edge deforms and moves into fitting portion 18. As a result, it is possible to reduce damage to locking body 7 by shock.

Further, according to the embodiment, since engagement portion 16 of locking mechanism 5 is formed inside the outer circumferential edge of operating button 8 and shock in several directions is distributed or absorbed inside and outside of operating button 8, it is possible to reduce damage to locking body 7.

Although the embodiments exemplify an iron case that receives an iron with the front inclined, the present invention is not limited thereto. For example, an iron may be received in a vertically standing position with the lower end facing down. Therefore, it is possible to make a small-sized iron case.

Further, the iron cases of the embodiments can be applied to a wireless iron that is placed on a table and supplied with power or an iron with a cord in which a power cord is directly connected to the iron.

Further, the embodiments may be implemented by appropriate combination or some of the embodiments may be combined.

INDUSTRIAL APPLICABILITY

An iron case of the present invention is useful for a common iron, a wireless iron, and an iron with a cord.

The invention claimed is:

1. An iron case comprising:

a table where an iron is placed;

a receiving case that surrounds the iron and has a lower opening that is closed by the table; and a locking mechanism that detachably combines the table with the receiving case, wherein the locking mechanism includes, a locking portion formed on a side of the table;

a locking body formed at the receiving case and engaged with the locking portion;

an operating button coupled to the locking body disposed on the outside surface of the receiving case configured to be moved in an outward direction away from the receiving case and to thereby disengage the locking body from the locking portion of the table;

a locking spring disposed in the receiving case configured to urge the operating button towards the table so that the locking body engages the locking portion of the table; and a claw formed at an upper end portion of the operating button; and a hole where the claw is inserted to a side of the receiving case from outside, and wherein the claw has a first contact portion that comes in contact with an outer surface around the hole of the receiving case and a second contact portion that comes in contact with an inner surface around the hole of the receiving case.

2. The iron case according to claim 1, wherein the locking spring defines a hook, the receiving case defines a receiving portion configured to engage with the hook defined by the locking spring, and the claw of the operating button is engaged into an inner side of the receiving case when a lower end of the hook is moved until the lower end comes in contact with the receiving portion of the receiving case.

3. The iron case according to claim 2, wherein a length defined by overlapping the second contact portion and the inner side of the receiving case is larger than a distance from the lower end of the hook of the locking spring to the receiving portion of the receiving case.

4. The iron case according to claim 1, wherein the locking portion defines a first engagement recess on a first side, and a second engagement recess on a second side; and wherein the receiving case defines a pair of engagement portions configured to matable engage the first and the second recesses, respectively, when the receiving case is mounted to the table.

5. The iron case according to claim 4, wherein the locking mechanism has a space where the engagement portion moves into an inner side of the engagement recess, with the engagement portion inserted in the engagement recess.

6. The iron case according to claim 1, wherein a recessed fitting portion where an outer circumferential edge of the operating button is fitted is formed on an outer surface of the receiving case.

7. The iron case according to claim 4, wherein the locking mechanism has the engagement portion disposed inside the outer circumferential edge of the operating button.

* * * * *